US008069700B2

(12) United States Patent
Liao

(10) Patent No.: US 8,069,700 B2
(45) Date of Patent: Dec. 6, 2011

(54) EFFORT-SAVING HAND TOOL

(75) Inventor: Chien-Chou Liao, Tu Cheng (TW)

(73) Assignee: Hanlong Industrial Co., Ltd., Taipei Hsien (TW)

( * ) Notice: Subject to any disclaimer, the term of this patent is extended or adjusted under 35 U.S.C. 154(b) by 430 days.

(21) Appl. No.: 12/468,971

(22) Filed: May 20, 2009

(65) Prior Publication Data

US 2010/0229696 A1 Sep. 16, 2010

(30) Foreign Application Priority Data

Mar. 11, 2009 (TW) ..... 98203740 U

(51) Int. Cl.
*H01R 43/00* (2006.01)

(52) U.S. Cl. ..... 72/409.16; 29/750

(58) Field of Classification Search ..... 72/409.1, 72/409.06, 409.08, 409.12, 409.16; 29/750
See application file for complete search history.

(56) References Cited

U.S. PATENT DOCUMENTS 3,230,758 A * 1/1966 Klingler ..... 72/409.06
3,710,611 A * 1/1973 Filia ..... 72/409.06
4,022,051 A * 5/1977 Ichikawa ..... 72/409.06
4,433,569 A * 2/1984 Santinelli ..... 72/409.01
5,074,142 A * 12/1991 Heskey et al. ..... 72/409.1
6,109,088 A * 8/2000 Schrader et al. ..... 72/409.16
7,444,851 B1 * 11/2008 Janson ..... 72/409.12
7,845,588 B1 * 12/2010 Goodick ..... 241/169
2005/0086993 A1 * 4/2005 Wang ..... 72/409.16
2008/0196473 A1 * 8/2008 Chiasson et al. ..... 72/409.06

* cited by examiner

*Primary Examiner* — Faye Francis

(74) *Attorney, Agent, or Firm* — Alan Kamrath; Kamrath & Associates PA

(57) ABSTRACT

An effort-saving hand tool includes a first shaft, a second shaft, a connection shaft, and a third shaft. The first shaft has a first end, a second end, and a pivot point located between the first end and the second end. The second end of the first shaft includes a first loading part. The second shaft has a first end and a second end. The pivot point of the first shaft is pivoted to the first end of the second shaft. The second end of the second shaft includes a second loading part. The connection shaft has a first end pivoted to the first shaft. The third shaft has a slender rear part, a first side, and a second side. The first side of the third shaft is pivoted to the second shaft. The second side of the third shaft is pivoted to a second end of the connection shaft.

18 Claims, 10 Drawing Sheets

EFFORT-SAVING HAND TOOL

BACKGROUND OF THE INVENTION

1. Field of the Invention

The present invention relates to a hand tool, and more particularly, the present invention relates to an effort-saving hand tool with a simple structure.

2. Description of the Related Art

Many kinds of effort-saving hand tools are widely used for different purposes, such as press connection or cutting. Please refer to FIG. 1. FIG. 1 is an illustration of a hand tool for press connection. In the prior art, a general effort-saving hand tool has two shafts pivoted to each other near a press area. The angle θ between the two shafts will vary greatly during the process of the press connection, which is not a parallel press connection. Therefore, the force is not equally applied to the connection terminal, and damage to the connection terminal may easily occur.

In addition, although there are different types of effort-saving hand tools, most types have complex designs that entail higher production costs and increased likelihood of malfunction.

Therefore, an effort-saving hand tool is needed to solve the problems of the prior art.

SUMMARY OF THE INVENTION

It is therefore an object of the present invention to provide an effort-saving hand tool with a simple structure for parallel press connection.

To achieve the object mentioned above, an effort-saving hand tool is disclosed. The effort-saving hand tool comprises a first shaft, a second shaft, a connection shaft, and a third shaft. The first shaft has a first end, a second end, and a pivot point located between the first end and the second end. The second end of the first shaft comprises a first loading part. The second shaft has a first end and a second end. The pivot point of the first shaft is pivoted to the first end of the second shaft. The second end of the second shaft comprises a second loading part. The connection shaft has a first end pivoted to the first shaft. The third shaft has a slender rear part, a first side, and a second side. The first side of the third shaft is pivoted to the second shaft. The second side of the third shaft is pivoted to a second end of the connection shaft.

According to one embodiment of the present invention, the first shaft and the second shaft form a V or Y shape.

Other objects, advantages, and novel features of the present invention will become more apparent from the following detailed description when taken in conjunction with the accompanying drawings.

BRIEF DESCRIPTION OF THE DRAWINGS

These and other objects and advantages of the present invention will become apparent from the following description of the accompanying drawings, which disclose several embodiments of the present invention. It is to be understood that the drawings are to be used for purposes of illustration only, and not as a definition of the invention.

In the drawings, wherein similar reference numerals denote similar elements throughout the several views.

DETAILED DESCRIPTION OF THE PREFERRED EMBODIMENT

Figure 1:
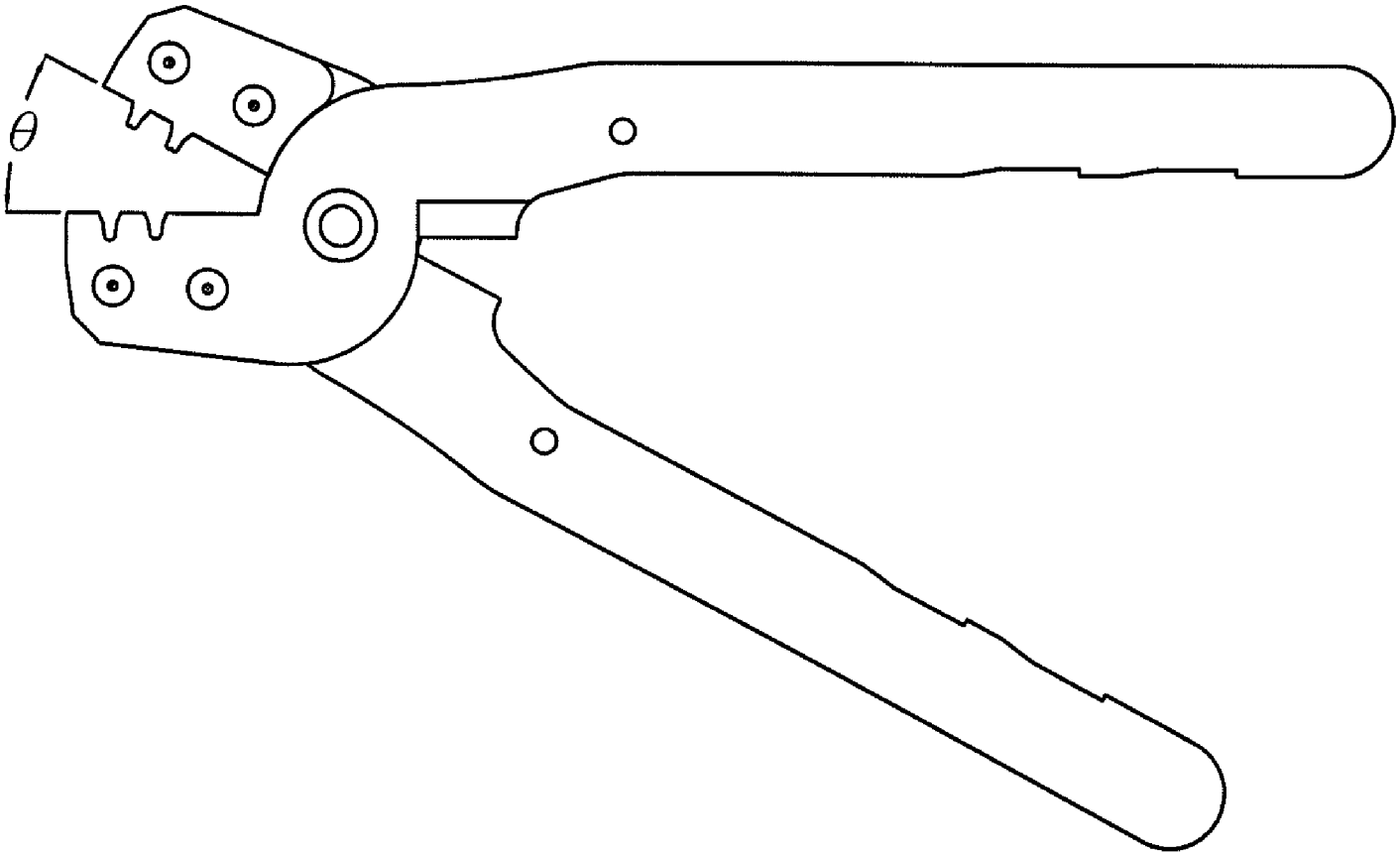
FIG. 1 (PRIOR ART)
FIG. 1 is an illustration of a hand tool for press connection in the prior art.
Figure 2:
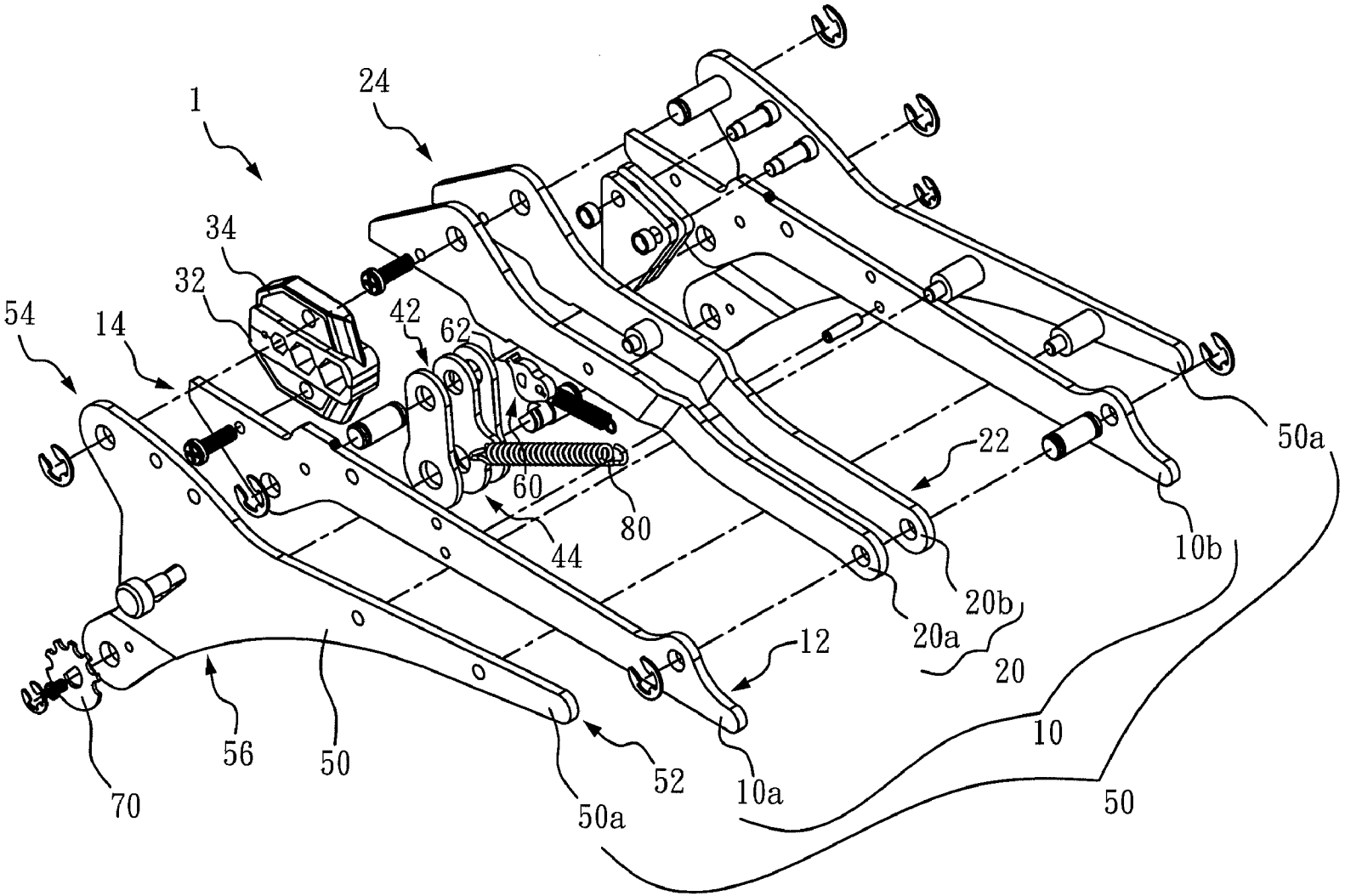
FIG. 2 is an exploded view of a first embodiment of the effort-saving hand tool of the present invention.
Figure 3:
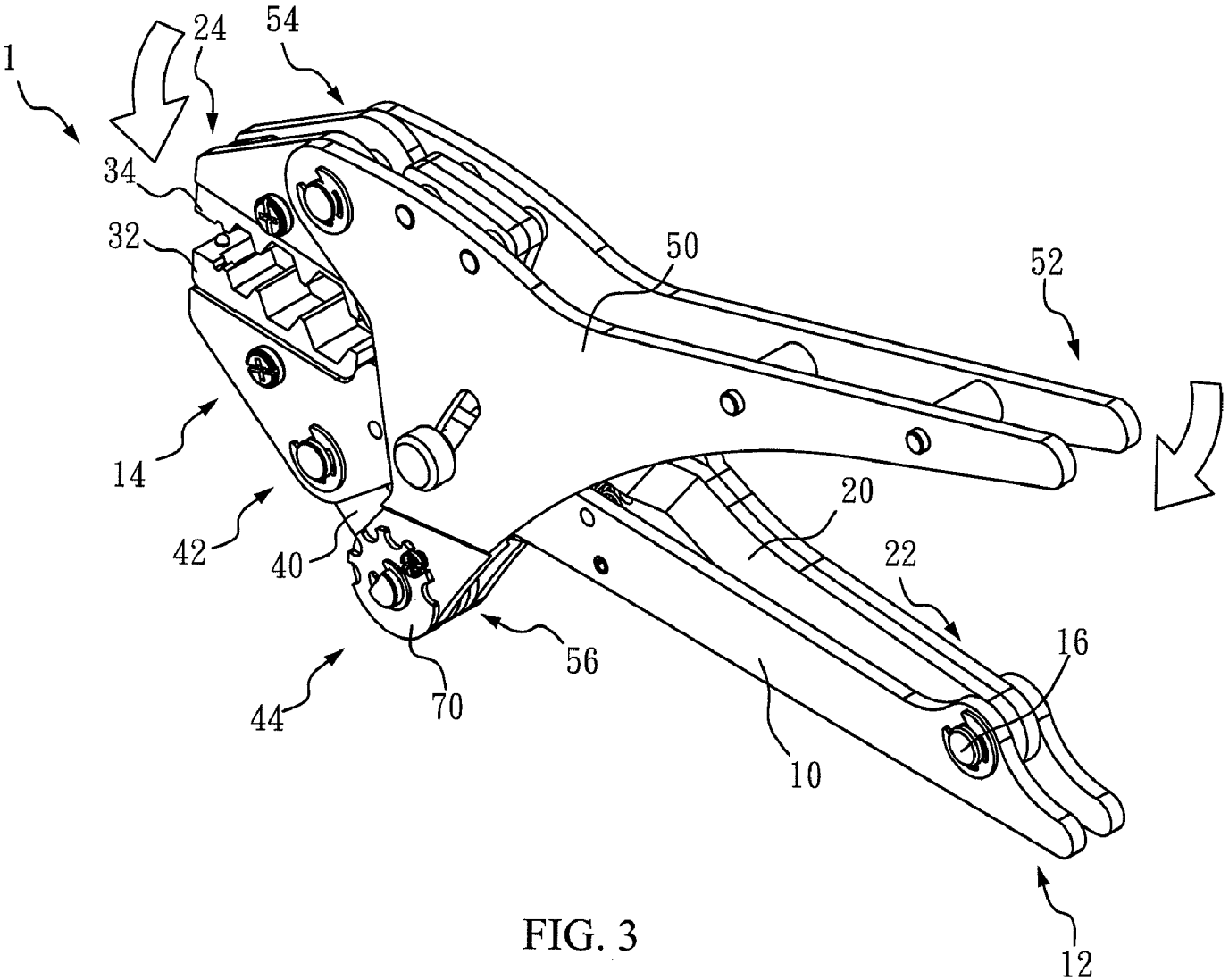
FIG. 3 is an illustration of the first embodiment of the effort-saving hand tool of the present invention before the state of press connection.
Figure 4:
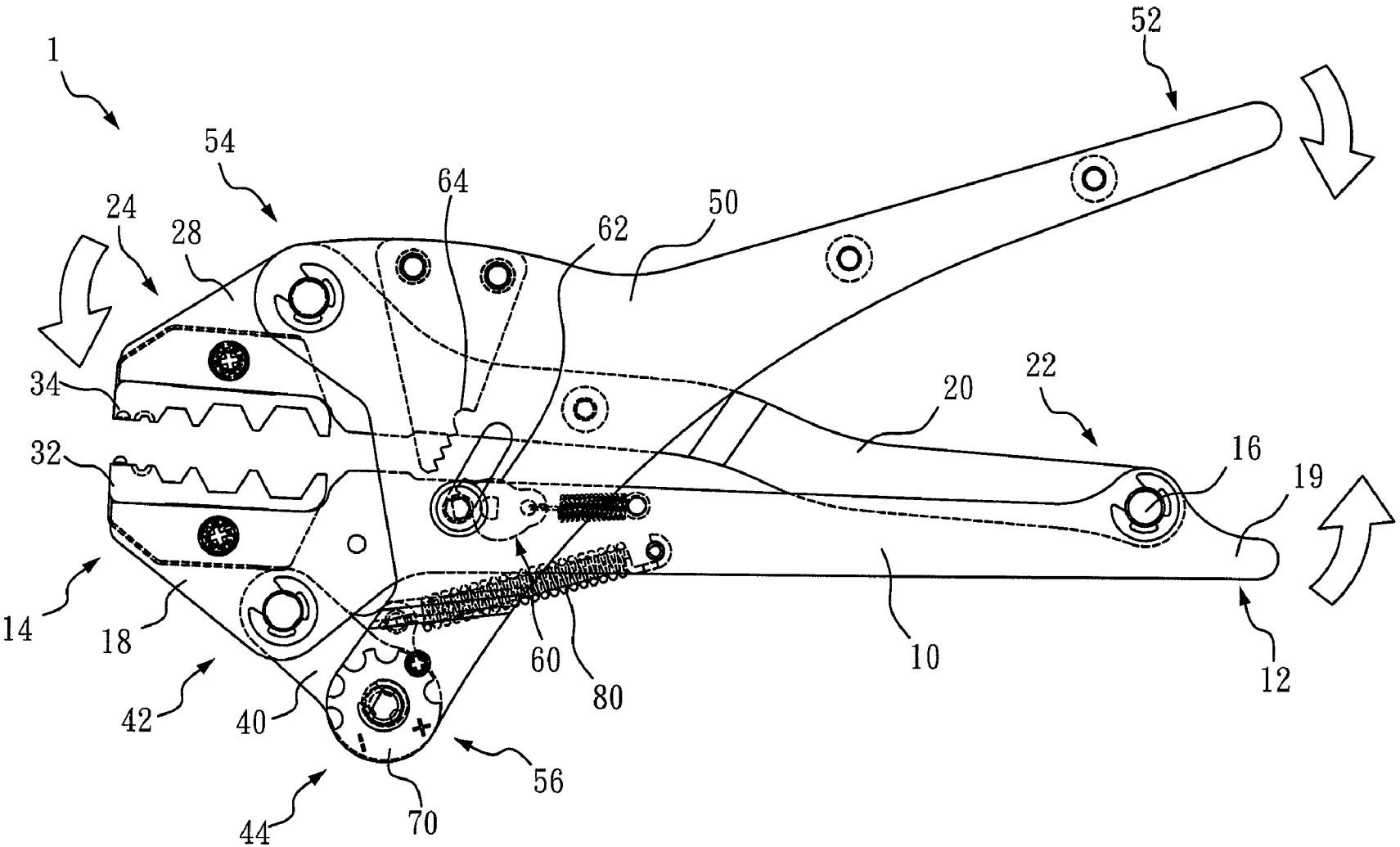
FIG. 4 is a front view of the first embodiment of the effort-saving hand tool of the present invention before the state of press connection.
Figure 4A:
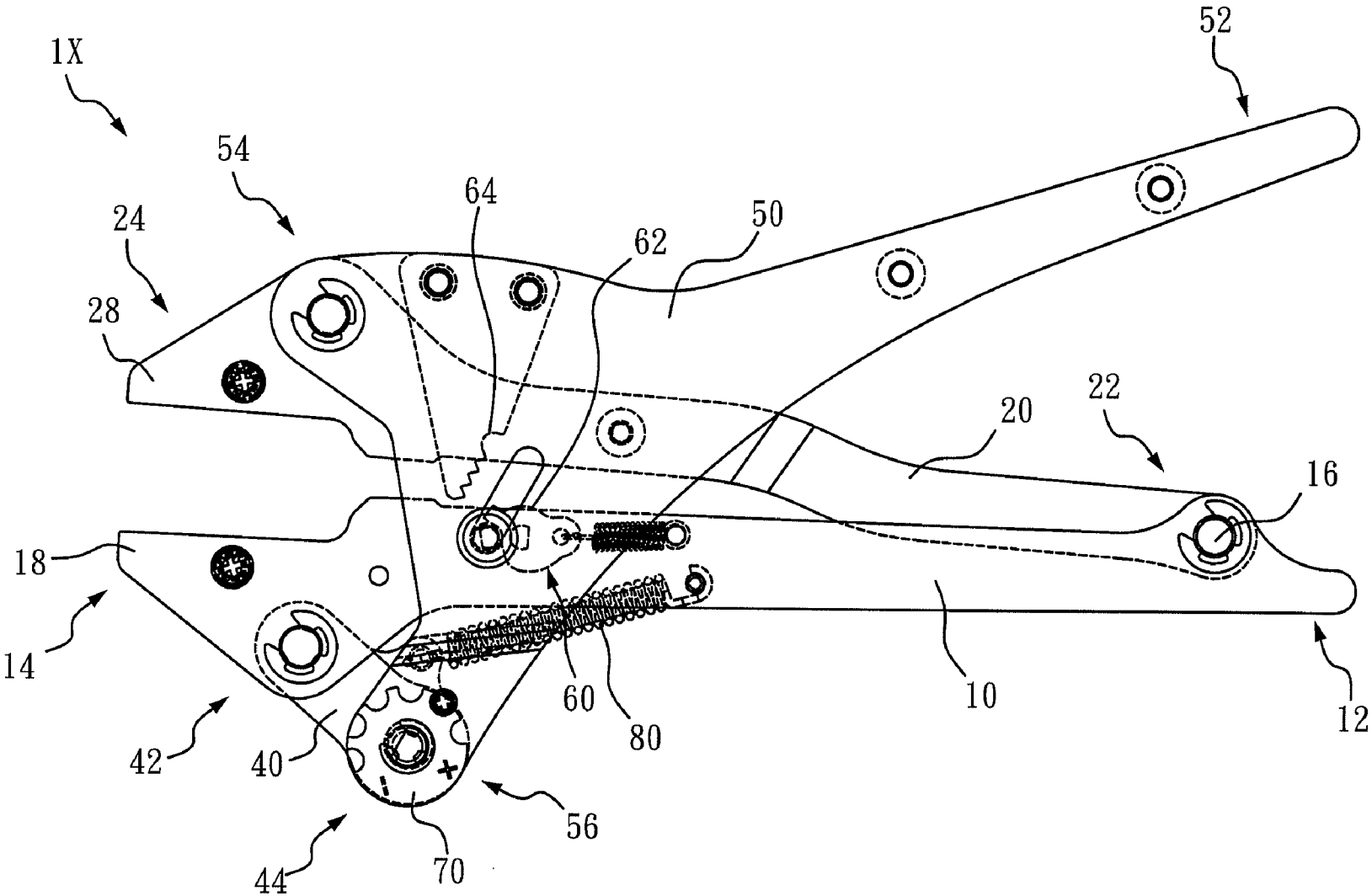
FIG. 4A is a front view of the effort-saving hand tool without a loading unit installed.
Figure 5:
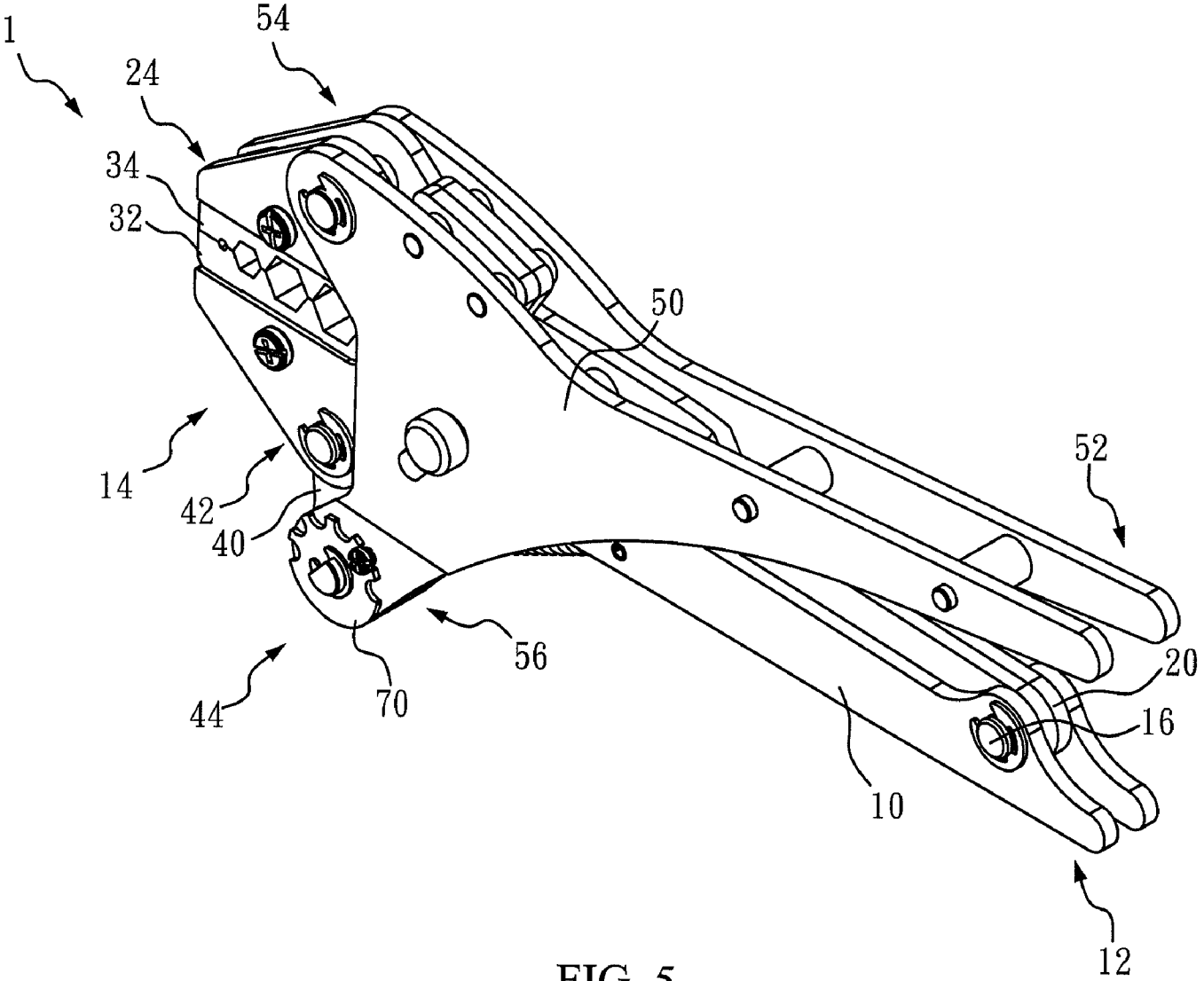
FIG. 5 is an illustration of the first embodiment of the effort-saving hand tool of the present invention in the state of press connection.
Figure 6:
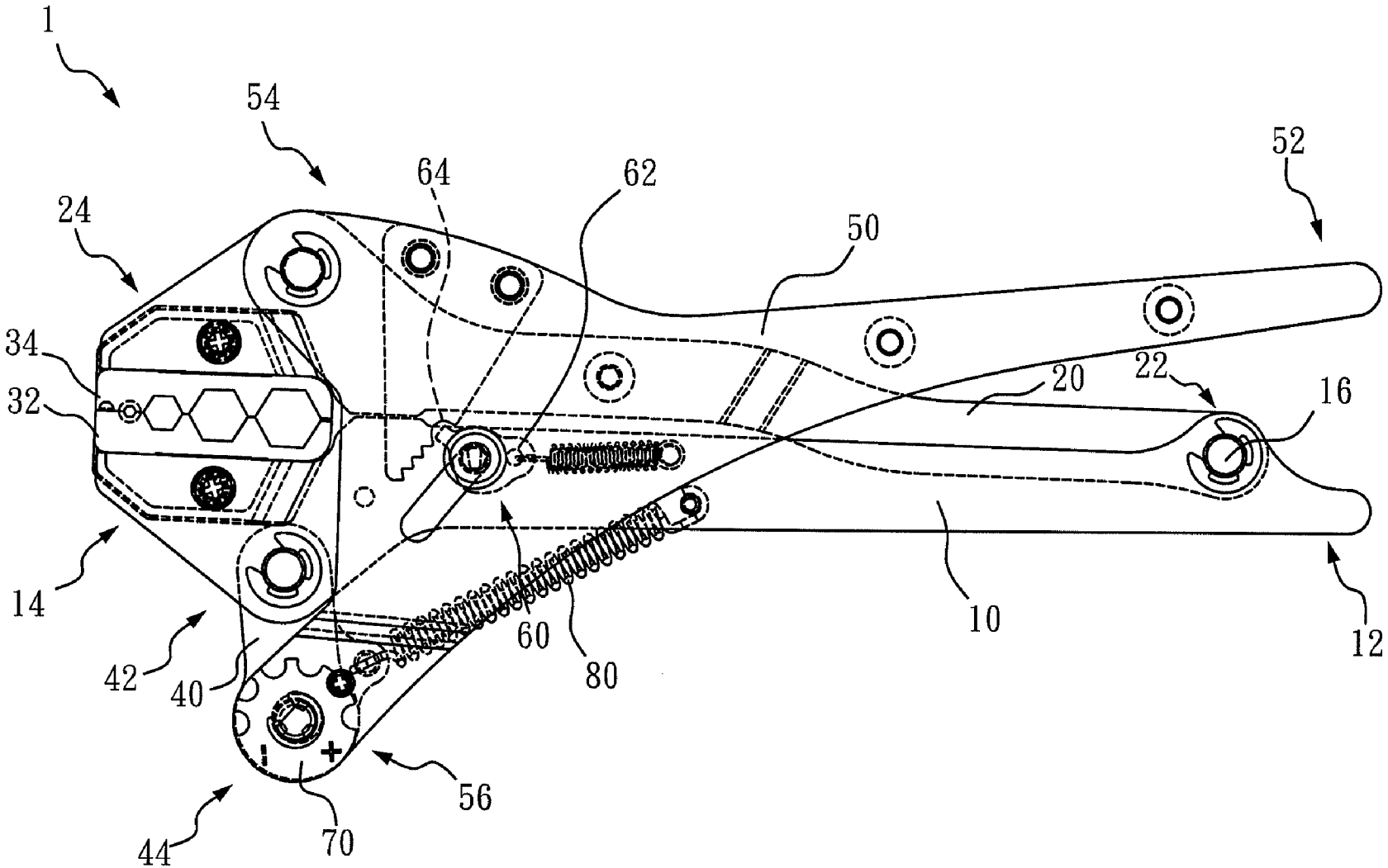
FIG. 6 is a front view of the first embodiment of the effort-saving hand tool of the present invention in the state of press connection.

Please refer to FIG. 2 to FIG. 6 for a first embodiment of an effort-saving hand tool of the present invention. FIG. 2 is an exploded view of the first embodiment of the effort-saving hand tool of the present invention. FIG. 3 is an illustration of the effort-saving hand tool before the state of press connection. FIG. 4 is a front view of the effort-saving hand tool before the state of press connection. FIG. 4A is a front view of the effort-saving hand tool without a loading unit installed. FIG. 5 is an illustration of the effort-saving hand tool in the state of press connection. FIG. 6 is a front view of the effort-saving hand tool in the state of press connection. In the present embodiment, the effort-saving hand tool 1 is especially suitable for the use of press connection.

The effort-saving hand tool 1 comprises a first shaft 10, a second shaft 20, a connection shaft 40, a third shaft 50, a ratchet mechanism 60, and an eccentric axis 70.

Please refer to FIG. 2 to FIG. 4 first. The first shaft 10 has a first end 12, a second end 14, and a pivot point 16. The first end 12 and its neighbor are provided for being held by the user. The first end 12 and the second end 14 are on opposite sides of the first shaft 10. The pivot point 16 is located between the first end 12 and the second end 14. In the present embodiment, the pivot point 16 is closer to the first end 12 than to the second end 14; in other words, the pivot point 16 is close to the rear part of the effort-saving hand tool 1. More particularly, the distance between the pivot point 16 and the second end 14 of the first shaft 10 is more than five times greater than the distance between the pivot point 16 and the first end 12 of the first shaft 10.

The second end 14 of the first shaft 10 comprises a first loading part 18 for transmitting applying force. The first loading part 18 can be connected with a first loading unit 32.

In the present embodiment, the first shaft 10 is formed with two first shaft units 10*a*, 10*b*. The first shaft unit 10*a* and the first shaft unit 10*b* are flat pieces in order to reduce weight and volume. The structure of the first shaft 10 is not limited by the above description.

The second shaft 20 has a first end 22 and a second end 24. The first end 22 and the second end 24 are on opposite sides of the second shaft 20. In the present embodiment, the pivot point 16 of the first shaft 10 is pivoted to the first end 22 of the second shaft 20, thus the first shaft 10 and the second shaft 20 forming a Y shape. A holding part 19 is extended from the first end 12 of the first shaft 10 to become the tail of the Y for being held by the user. In addition, the first end 22 of the second shaft 20 can also be extended to become the tail of the Y.

The shape formed by the first shaft 10 and the second shaft 20 is not limited by the above description. For example, the first shaft 10 and the second shaft 20 can also form a V shape.

The second end 24 of the second shaft 20 comprises a second loading part 28 for transmitting applied force. The second loading part 28 can be connected with a second loading unit 34.

In the present embodiment, the second shaft 20 is formed with two second shaft units 20*a*, 20*b*. The second shaft unit 20*a* and the second shaft unit 20*b* are flat pieces in order to reduce weight and volume. The structure of the second shaft 20 is not limited by the above description.

Because the first shaft 10 and the second shaft 20 have long lever arms, the user can complete the press connection with reduced effort as compared to the hand tool of the prior art due to the mechanical advantage provided by the lengths of the lever arms.

The first loading unit 32 and the second loading unit 34 are explained below. The first loading unit 32 and the second loading unit 34 are mold blocks for press connection. The first loading unit 32 is detachably connected to the first loading part 18 of the first shaft 10. The second loading unit 34 is detachably connected to the second loading part 28 of the second shaft 20. FIG. 4A illustrates a situation with the first loading unit 32 and the second loading unit 34 removed. The shapes of the first loading unit 32 and the second loading unit 34 correspond to each other to form a press area.

In FIG. 4, the first loading unit 32 and the second loading unit 34 form a hexagonal press area for press connecting a hexagonal terminal. The first loading unit 32 and the second loading unit 34 can be changed to other shapes for different types of terminals.

The structures of the first loading unit 32 and the second loading unit 34 may vary according to requirements. For example, the first loading unit 32 can have a slot for both press connection and cutting in order to provide more functions.

In addition, the first loading unit 32 and the first loading unit 18 can be integrated into one piece, and the second loading unit 34 and the second loading unit 28 can also be integrated into one piece.

The first end 42 of the connection shaft 40 is pivoted to the first shaft 10, and the second end 44 of the connection shaft 40 is pivoted to the third shaft 50. The connection shaft 40 is utilized for transmitting applied force.

The third shaft 50 comprises a slender rear part 52, a first side 54, and a second side 56. The first side 54 of the third shaft 50 is pivoted to the second shaft 20, and the second side 56 of the third shaft 50 is pivoted to the second end 44 of the connection shaft 40. The slender rear part 52 is provided for being held by the user, especially near the end of the slender rear part 52.

In the present embodiment, the third shaft 50 is formed with two third shaft units 50*a*, 50*b*. The third shaft unit 50*a* and the third shaft unit 50*b* are flat pieces in order to reduce weight and volume. In addition, the third shaft 50 is on the outer sides of the first shaft 10.

More particularly, the structures and shapes of the first shaft 10, the second shaft 20, and the third shaft 50 are not limited by the above description. For example, the first shaft 10, the second shaft 20, and/or the third shaft 50 can be made of bent metal plates (U-shaped, for example), or by plastic injection molding.

The ratchet mechanism 60 is utilized for allowing the user to apply force intermittently, such that the first loading unit 32 and the second loading unit 34 can gradually approach each other for press connection. The ratchet mechanism 60 is installed between the first shaft 10 and the third shaft 50. The ratchet mechanism 60 comprises a pawl 62 and a ratchet wheel 64. The pawl 62 is connected to the first shaft 10. The ratchet wheel 64 is connected to the third shaft 50. The pawl 62 is capable of fixing the ratchet wheel 64 in the desired position.

The ratchet mechanism 60 is not limited by the above description. For example, the ratchet mechanism 60 can also be installed between the first shaft 10 and the second shaft 20, or between the second shaft 20 and the third shaft 50. The ratchet mechanism 60 is a common design in a hand tool of the prior art; therefore, it is not described further.

The eccentric axis 70 is utilized for compensating for dimension error due to inaccuracy or abrasion. The eccentric axis 70 is installed between the second end 44 of the connection shaft 40 and the second side 56 of the third shaft 50.

The eccentric axis 70 is not limited by the above description. For example, the eccentric axis 70 can also be installed between the first end 42 of the connection shaft 40 and the first shaft 10. The eccentric axis 70 is a common design of a hand tool of the prior art; therefore, it is not described further.

The ratchet mechanism 60 and/or the eccentric axis 70 can be omitted if the function of the hand tool already meets requirements.

Please refer to FIG. 3 to FIG. 6 for illustration of the effort-saving hand tool 1 when being used. As shown in FIG. 3 and FIG. 4, before the state of press connection, the first end 12 of the first shaft 10 is far from the slender rear part 52 of the third shaft 50, and there is a gap between the first loading unit 32 and the second loading unit 34. A terminal (not shown) can be inserted between the first loading unit 32 and the second loading unit 34.

When in the state of press connection, the user applies force on both the first end 12 of the first shaft 10 and the slender rear part 52 of the third shaft 50, and then the first end 12 of the first shaft 10 and the slender rear part 52 of the third shaft 50 move closer to each other (as indicated by arrows on the right side of FIG. 4). According to the design, the third shaft 50 will drive the second shaft 20 and the connection shaft 40 to reduce the angle between the first shaft 10 and the second shaft 20 (as indicated by the arrow on the left side of FIG. 4), and finally the gap between the first shaft 10 and the second shaft 20 will be closed, as shown in FIG. 6.

In the present embodiment, the first shaft 10, the second shaft 20, the connection shaft 40, and the third shaft 50 form a toggle mechanism to reduce the amount of applied force required. In addition, when the second loading unit 34 moves closer to the first loading unit 32, the second loading unit 34 keeps almost parallel to the first loading unit 32, which causes the force to be equally applied to the connection terminal.

Figure 7:
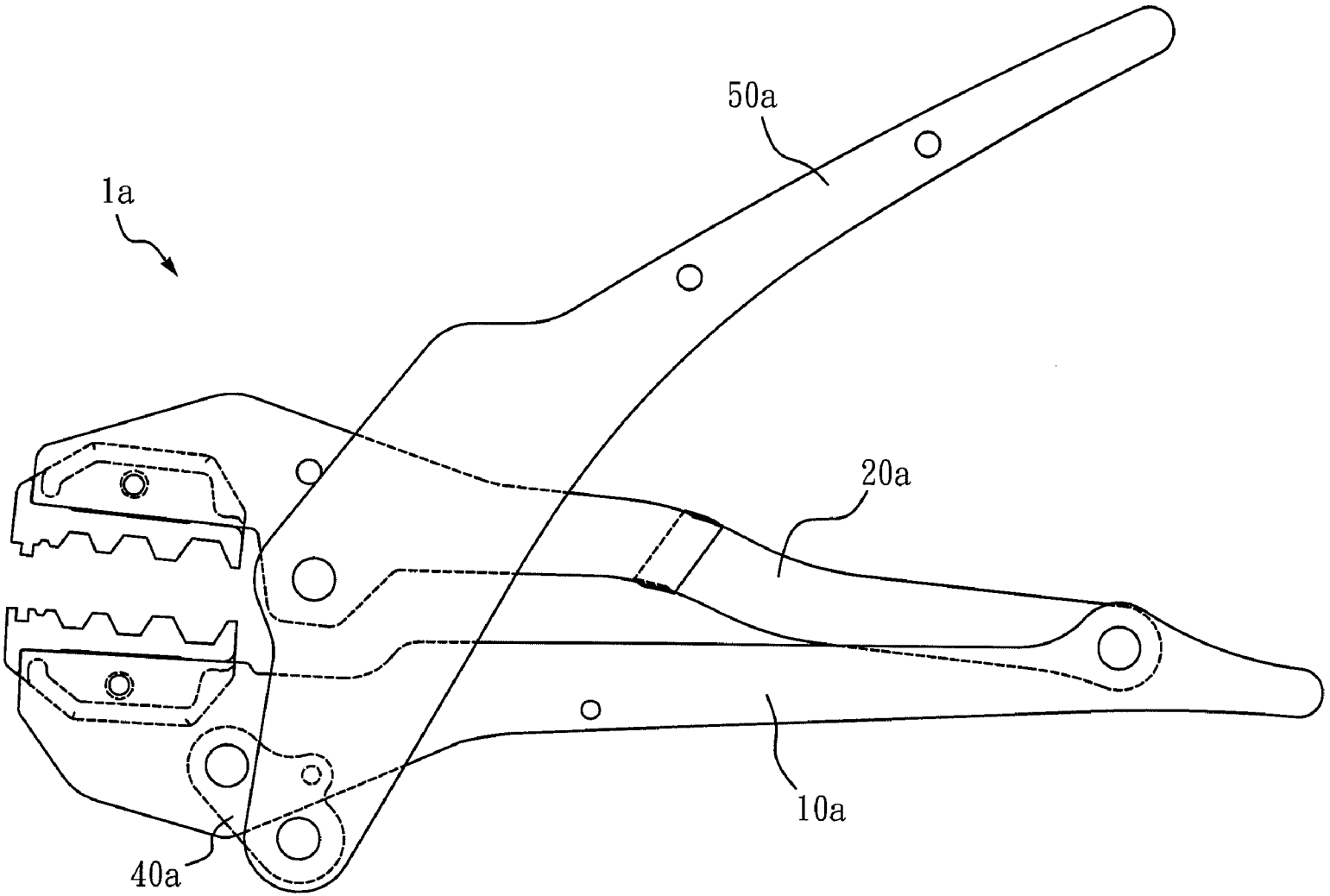
FIG. 7 is a front view of a second embodiment of the effort-saving hand tool of the present invention before the state of press connection.
Figure 8:
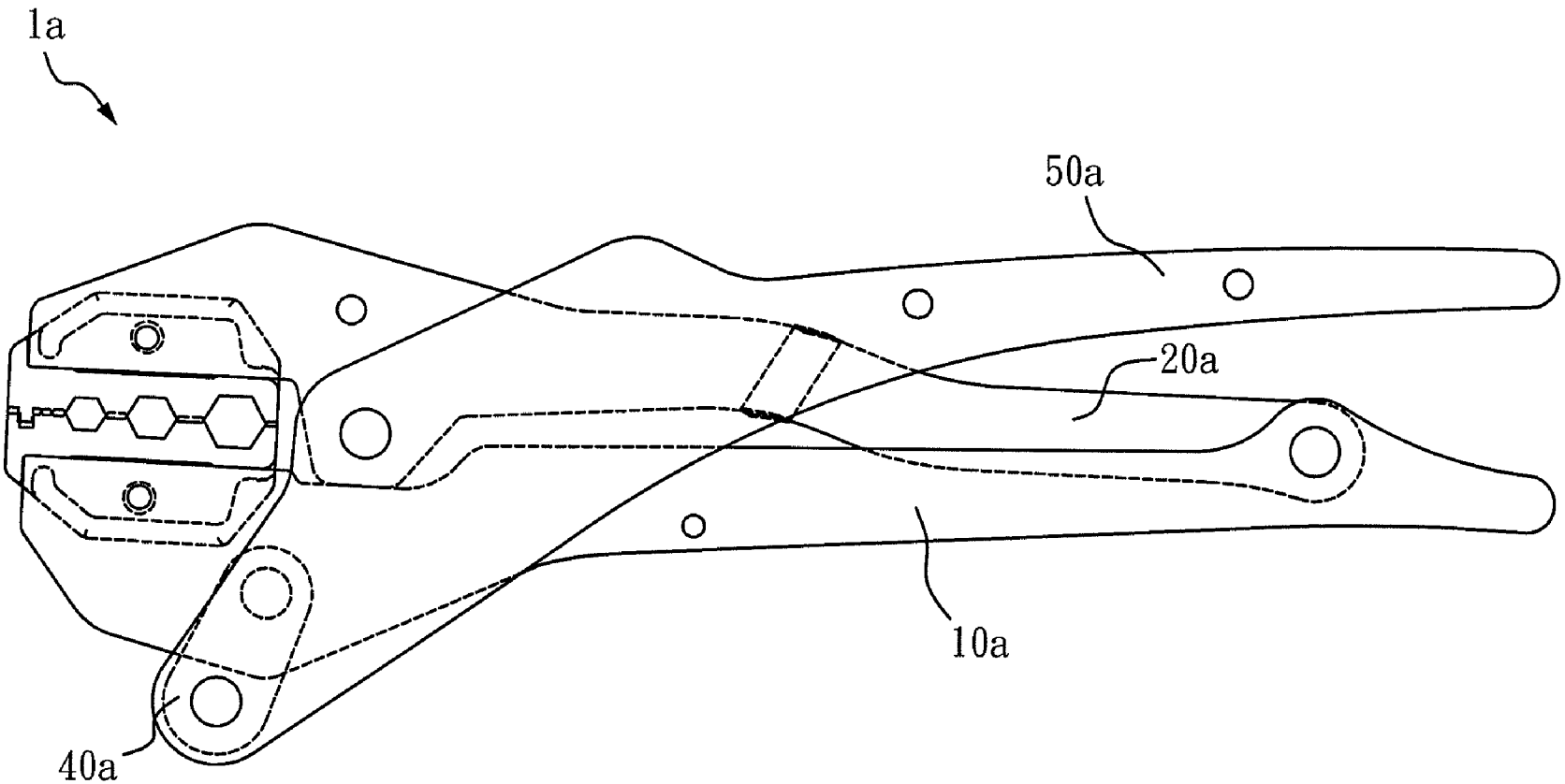
FIG. 8 is a front view of the second embodiment of the effort-saving hand tool of the present invention in the state of press connection.

Please refer to FIG. 7 and FIG. 8 for an illustration of a second embodiment of the effort-saving hand tool of the present invention. The effort-saving hand tool 1*a* comprises a first shaft 10*a*, a second shaft 20*a*, a connection shaft 40*a*, and a third shaft 50*a*. What is different from the first embodiment is that the effort-saving hand tool 1*a* comprises a ratchet mechanism and a eccentric axis. The pivot point between the third shaft 50*a* and the second shaft 20*a* is also different.

Figure 9:
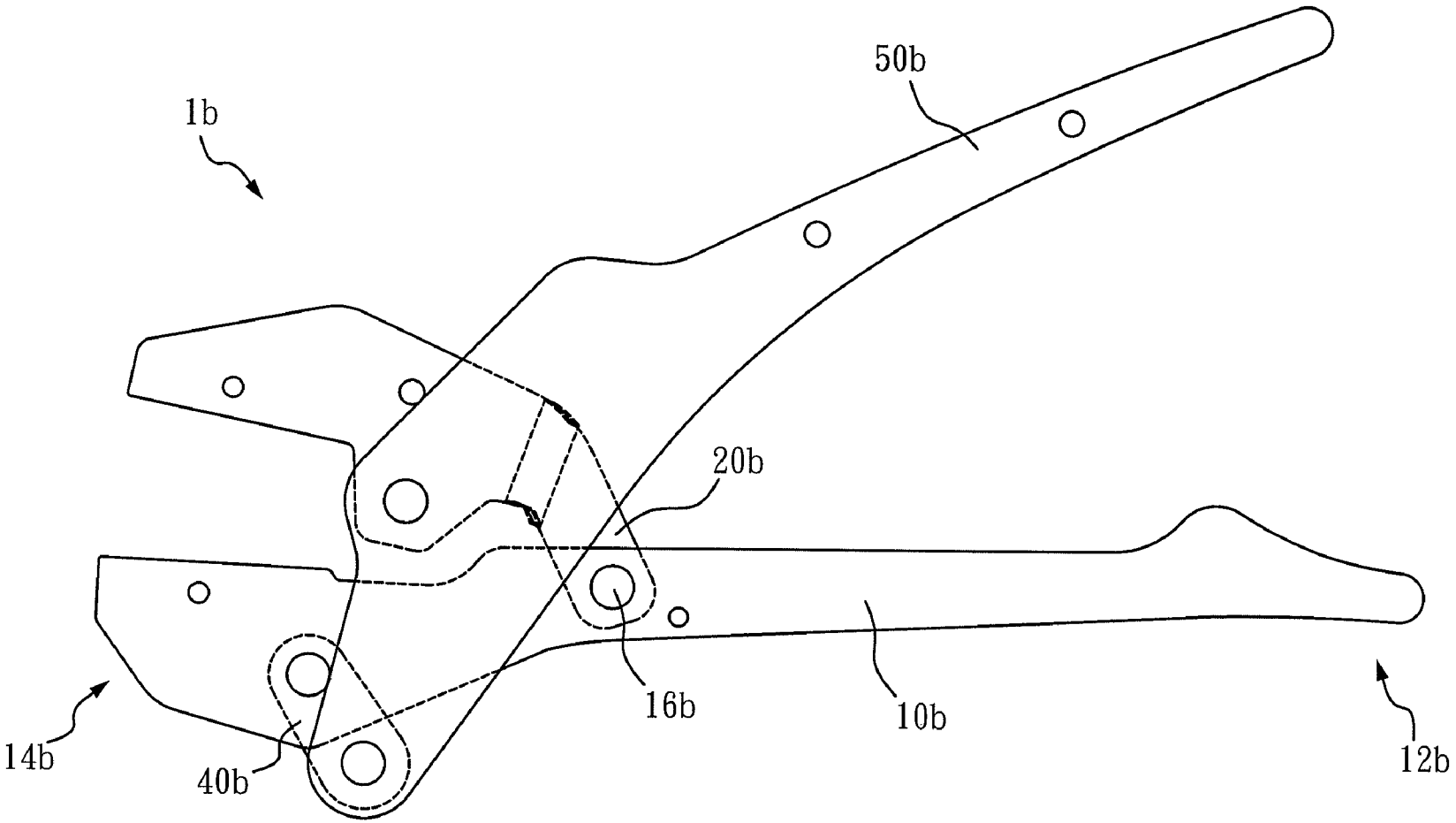
FIG. 9 is a front view of a third embodiment of the effort-saving hand tool of the present invention.

Please refer to FIG. 9 for an illustration of a third embodiment of the effort-saving hand tool of the present invention. The effort-saving hand tool 1*b* comprises a first shaft 10*b*, a second shaft 20*b*, a connection shaft 40*b*, and a third shaft 50*b*. The first shaft 10*b* comprises a first end 12*b*, a second end

14*b*, and a pivot point 16*b*. What is different from the second embodiment is that the pivot point 16*b* is closer to the second end 14*b* of the first shaft 10*b* than to the first end 12*b* of the first shaft 10*b*.

Although the present invention has been explained in relation to its preferred embodiments, it is to be understood that many other possible modifications and variations can be made without departing from the spirit and scope of the invention as hereinafter claimed.

What is claimed is:

1. An effort-saving hand tool comprising:

a first shaft having a first end, a second end, and a pivot point located between the first end and the second end, the second end of the first shaft comprising a first loading part;

a second shaft having a first end and a second end, the pivot point of the first shaft being pivoted to the first end of the second shaft, and the second end of the second shaft comprising a second loading part;

a connection shaft having a first end and a second end, the first end of the connection shaft being pivoted to the first shaft; and a third shaft having a slender rear part, a first side, and a second side, the first side of the third shaft being pivoted to the second shaft, and the second side of the third shaft being pivoted to the second end of the connection shaft.

2. The effort-saving hand tool as claimed in claim 1, further comprising an eccentric axis installed between the second end of the connection shaft and the second side of the third shaft, or between the first end of the connection shaft and the first shaft.

3. The effort-saving hand tool as claimed in claim 1, wherein the first shaft and the second shaft form a V shape or a Y shape.

4. The effort-saving hand tool as claimed in claim 1, further comprising a first loading unit and a second loading unit, wherein the first loading unit is detachably connected to the first loading part of the first shaft, and the second loading unit is detachably connected to the second loading part of the second shaft.

5. The effort-saving hand tool as claimed in claim 1, wherein the first loading part comprises a first loading unit, and the second loading part comprises a second loading unit.

6. The effort-saving hand tool as claimed in claim 1, wherein the pivot point is closer to the first end of the first shaft than to the second end of the first shaft.

7. The effort-saving hand tool as claimed in claim 6, wherein the distance between the pivot point and the second end of the first shaft is more than five times greater than the distance between the pivot point and the first end of the first shaft.

8. The effort-saving hand tool as claimed in claim 1, wherein the pivot point is closer to the second end of the first shaft than to the first end of the first shaft.

9. The effort-saving hand tool as claimed in claim 1, further comprising a holding part extended from the first end of the first shaft, or extended from the first end of the second shaft.

10. The effort-saving hand tool as claimed in claim 1, further comprising a ratchet mechanism installed between the first shaft and the third shaft, or between the first shaft and the second shaft, or between the second shaft and the third shaft.

11. The effort-saving hand tool as claimed in claim 10, further comprising an eccentric axis installed between the second end of the connection shaft and the second side of the third shaft, or between the first end of the connection shaft and the first shaft.

12. The effort-saving hand tool as claimed in claim 10, wherein the first shaft and the second shaft form a V shape or a Y shape.

13. The effort-saving hand tool as claimed in claim 10, further comprising a first loading unit and a second loading unit, wherein the first loading unit is detachably connected to the first loading part of the first shaft, and the second loading unit is detachably connected to the second loading part of the second shaft.

14. The effort-saving hand tool as claimed in claim 10, wherein the first loading part comprises a first loading unit, and the second loading part comprises a second loading unit.

15. The effort-saving hand tool as claimed in claim 10, wherein the pivot point is closer to the first end of the first shaft than to the second end of the first shaft.

16. The effort-saving hand tool as claimed in claim 15, wherein the distance between the pivot point and the second end of the first shaft is more than five times greater than the distance between the pivot point and the first end of the first shaft.

17. The effort-saving hand tool as claimed in claim 10, wherein the pivot point is closer to the second end of the first shaft than to the first end of the first shaft.

18. The effort-saving hand tool as claimed in claim 10, further comprising a holding part extended from the first end of the first shaft, or extended from the first end of the second shaft.

* * * * *